US010125770B2

(12) United States Patent
Ogawa et al.

(10) Patent No.: US 10,125,770 B2
(45) Date of Patent: Nov. 13, 2018

(54) CYLINDER-ROTATION COMPRESSOR WITH A DISCHARGE VALVE

(71) Applicants: DENSO CORPORATION, Kariya, Aichi-pref. (JP); NIPPON SOKEN, INC., Nishio, Aichi-pref. (JP)

(72) Inventors: Hiroshi Ogawa, Nishio (JP); Yoshinori Murase, Kariya (JP)

(73) Assignees: DENSO CORPORATION, Kariya, Aichi-pref. (JP); SOKEN, INC., Nisshin, Aichi-pref. (JP)

( * ) Notice: Subject to any disclaimer, the term of this patent is extended or adjusted under 35 U.S.C. 154(b) by 204 days.

(21) Appl. No.: 15/106,957

(22) PCT Filed: Dec. 23, 2014

(86) PCT No.: PCT/JP2014/006407
§ 371 (c)(1),
(2) Date: Jun. 21, 2016

(87) PCT Pub. No.: WO2015/098097
PCT Pub. Date: Jul. 2, 2015

(65) Prior Publication Data

US 2017/0030357 A1 Feb. 2, 2017

(30) Foreign Application Priority Data

Dec. 25, 2013 (JP) ..... 2013-266538

(51) Int. Cl.
*F04C 29/12* (2006.01)
*F04C 18/344* (2006.01)
*F04C 18/46* (2006.01)

(52) U.S. Cl.
CPC ..... *F04C 29/126* (2013.01); *F04C 18/344* (2013.01); *F04C 18/46* (2013.01); *F04C 29/128* (2013.01); *F04C 2240/40* (2013.01)

(58) Field of Classification Search
CPC ..... F04C 18/344; F04C 18/356; F04C 18/46; F04C 29/126; F04C 29/128
See application file for complete search history.

(56) References Cited

U.S. PATENT DOCUMENTS 8,790,099 B2 * 7/2014 Qu ..... F04C 18/332 418/172
2012/0076678 A1 3/2012 Yamashita
(Continued)

FOREIGN PATENT DOCUMENTS

JP S53043682 B2 11/1978
JP H01054560 B2 11/1989
(Continued)

*Primary Examiner* — Mary A Davis
(74) *Attorney, Agent, or Firm* — Harness, Dickey & Pierce, P.L.C.

(57) ABSTRACT

A cylinder-rotation-type compressor includes a discharge valve that is disposed in a cylinder and configured by a reed valve, a valve body portion that closes a discharge hole provided in the cylinder, and a support portion that couples the valve body portion with a fixing portion fixed to the cylinder. A shape of the valve body portion and a shape of the support portion are substantially symmetrical with respect to a line segment extending in a radial direction of a rotating axis. The valve body portion is disposed on a radially outer side of a connection portion of the fixing portion and the support portion.

5 Claims, 10 Drawing Sheets

(56) References Cited

U.S. PATENT DOCUMENTS

| | | | | |
|---|---|---|---|---|
| 2015/0176583 | A1 | 6/2015 | Murase et al. | |
| 2016/0115957 | A1* | 4/2016 | Murase ..... | F04C 18/332<br>417/410.3 |

FOREIGN PATENT DOCUMENTS

| | | | |
|---|---|---|---|
| JP | 2012067735 | A | 4/2012 |
| JP | 2014005795 | A | 1/2014 |

* cited by examiner

CYLINDER-ROTATION COMPRESSOR WITH A DISCHARGE VALVE

CROSS REFERENCE TO RELATED APPLICATIONS

This application is a U.S. National Phase Application under 35 U.S.C. 371 of International Application No. PCT/JP2014/006407 filed on Dec. 23, 2014 and published in Japanese as WO 2015/098097 A1 on Jul. 2, 2015. This application is based on and claims the benefit of priority from Japanese Patent Application No. 2013-266538 filed on Dec. 25, 2013. The entire disclosures of all of the above applications are incorporated herein by reference.

TECHNICAL FIELD

The present disclosure relates to a cylinder-rotation-type compressor that rotates a cylinder internally having a compression chamber.

BACKGROUND ART

Up to now, cylinder-rotation-type compressors that rotate a cylinder internally having a compression chamber, and change a capacity of the compression chamber to compress and discharge a fluid have been known.

For example, Patent Document 1 discloses a cylinder-rotation-type compressor that includes a cylinder internally provided with a space having an elliptical cross-section perpendicular to an axial direction of the space, a cylindrical member which is disposed inside the cylinder, and a partition member (vane) which is slidably fitted into a groove portion provided in the cylindrical member and partitions a compression chamber, in which the cylinder is rotated relative to the cylindrical member to displace the vane and change a capacity of the compression chamber.

Patent Document 2 discloses a cylinder-rotation-type compressor that includes a cylinder internally provided with a space having an circular cross-section perpendicular to an axial direction of the space, a rotor that is formed of a cylindrical member disposed inside the cylinder, and a vane which is slidably fitted into a groove portion provided in the rotor, in which the cylinder and the rotor are interlockingly rotated with different rotating axes to displace the vane and change a capacity of a compression chamber.

Incidentally, in the cylinder of the cylinder-rotation-type compressor of this type, for example, as disclosed in Patent Document 1, a discharge hole for allowing a fluid compressed in the compression chamber to flow out is provided, and a discharge valve for preventing the fluid from flowing back into the compression chamber through the discharge hole is provided.

In the cylinder-rotation-type compressor described above, a centrifugal force acts on the discharge valve when the cylinder rotates. For that reason, there is a risk that the fluid cannot be compressed and discharged when a valve body portion of the discharge valve is displaced due to an action of the centrifugal force so that the discharge hole cannot be closed in rotating the cylinder with a relatively high rotation.

On the contrary, a configuration in which an elastic member for applying a load to a side where the discharge hole is closed is added to the valve body portion of the discharge valve is proposed. However, the addition of the elastic member may cause an increase in the size of the discharge valve, resulting in an upsizing of the overall cylinder-rotation-type compressor.

PRIOR ART DOCUMENT

Patent Document

Patent Document 1: JP S53-043682 B
Patent Document 2: JP 2012-067735 A

SUMMARY OF THE INVENTION

In view of the above circumstances, an object of the present disclosure is to improve a sealing property of a discharge valve without any increase in the size of the discharge valve in a cylinder-rotation-type compressor.

According to an aspect of the present disclosure, a cylinder-rotation-type compressor includes a rotatable cylinder, a columnar member, and a partition member. The cylinder includes a cylindrical member which extends in an axial direction of a rotating axis, and a closing member which closes an end of the cylindrical member in the axial direction. The columnar member is housed inside the cylinder and extends in the axial direction of the rotating axis of the cylinder. The partition member is slidably fitted into a groove portion provided in one of the cylinder and the columnar member, and partitions a compression chamber provided between the cylinder and the columnar member. The closing member includes a discharge hole through which a fluid compressed in the compression chamber flows out of the compression chamber. The cylinder-rotation-type compressor further includes a discharge valve that limits backward flow of the fluid into the compression chamber through the discharge hole. The discharge valve is a plate-shaped member, and includes a valve body portion that closes the discharge hole, a fixing portion that is fixed to the cylinder, and a support portion that couples the valve body portion with the fixing portion. A shape of the valve body portion and a shape of the support portion are substantially symmetrical with respect to a line segment extending in a radial direction of the rotating axis when viewed from the axial direction of the rotating axis. The valve body portion is disposed on a radially outer side of a connection portion connecting the fixing portion and the support portion.

According to the above configuration, the discharge valve is a plate-shaped member, and includes the valve body portion, the fixing portion, and the support portion. Since the discharge valve is configured by a so-called reed valve, an increase in the size of the discharge valve can be suppressed.

Since the valve body portion and the support portion are substantially symmetrical with respect to the line segment extending in the radial direction of the rotating axis, the valve body portion is hardly displaced in the rotation direction (circumferential direction) of the rotating axis even if the centrifugal force acts on the valve body portion. In addition, since the valve body portion is disposed on the radially outer side than the connection portion connecting the fixing portion and the support portion, the valve body portion is hardly displaced in the radial direction of the rotating axis even if the centrifugal force acts on the valve body portion.

Therefore, according to the disclosure of the claims, the sealing property of the discharge valve can be improved without any increase in the size of the discharge valve.

EMBODIMENTS FOR EXPLOITATION OF THE INVENTION

Figure 1:
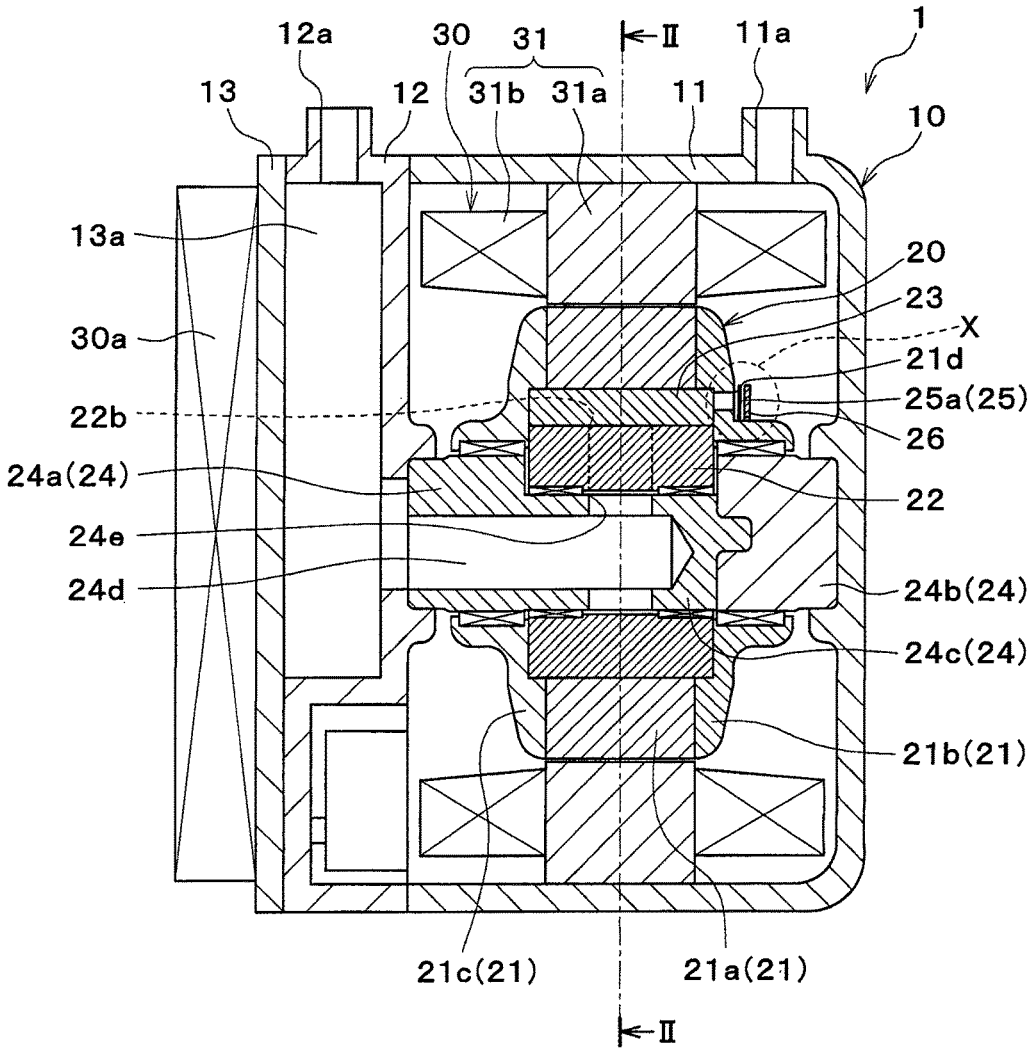
FIG. 1 is an axial cross-sectional view illustrating a compressor according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A first embodiment of the present disclosure will be described with reference to FIGS. 1 to 5. A cylinder-rotation-type compressor 1 (hereinafter referred to simply as "compressor 1") according to the present embodiment is applied to a vapor compression refrigeration cycle that cools a blown air blown into a vehicle interior by a vehicle air conditioning apparatus, and performs a function of compressing and discharging a refrigerant that is a fluid in the refrigeration cycle.

Figure 2:
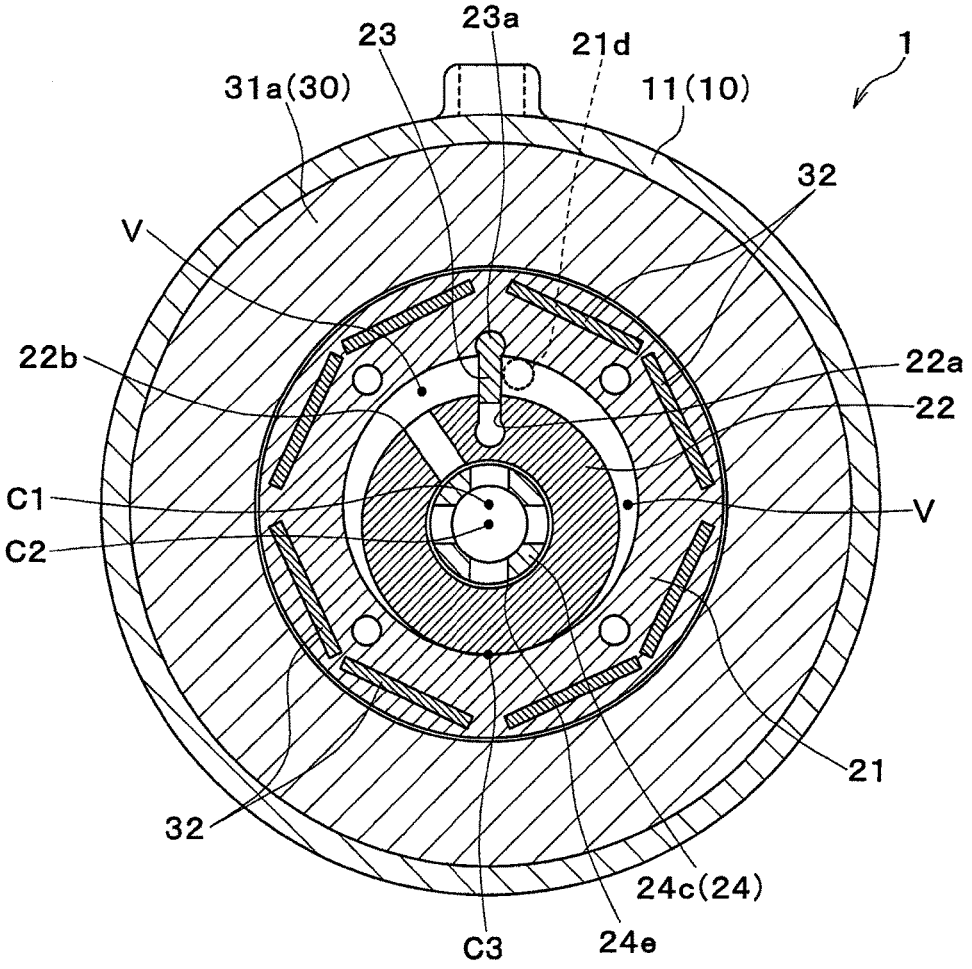
FIG. 2 is a cross-sectional view taken along a line II-II in FIG. 1.

As illustrated in FIGS. 1 and 2, the compressor 1 is configured as an electric compressor that houses a compression mechanism portion 20 that compresses and discharges the refrigerant, and an electric motor portion (electric motor portion) 30 that drives the compression mechanism portion 20 inside a housing 10 forming an outer shell of the compressor 1.

First, the housing 10 is configured by the combination of multiple metal members, and has a sealed container structure with a substantially cylindrical space inside the housing 10. More specifically, the housing 10 according to the present embodiment is configured by the combination of a bottomed cylindrical (cup-shaped) main housing 11, a bottomed cylindrical sub-housing 12 disposed to close an opening portion of the main housing 11, and a disk-shaped lid member 13 disposed to close an opening portion of the sub-housing 12.

A sealing member not shown formed of an O-ring intervenes in each abutment part of the main housing 11, the sub-housing 12, and the lid member 13, and the refrigerant is not leaked from each abutment part.

A discharge port 11*a* for discharging a high-pressure refrigerant pressurized by the compression mechanism portion 20 to an external (specifically, refrigerant inlet side of a condenser of the refrigeration cycle) of the housing 10 is disposed in a cylindrical side surface of the main housing 11. A suction port 12*a* for suctioning a low-pressure refrigerant (specifically, a low-pressure refrigerant flowing out of an evaporator of the refrigeration cycle) from the external of the housing 10 is provided in a cylindrical side surface of the sub-housing 12.

A suction passage 13*a* for introducing the low-pressure refrigerant suctioned from the suction port 12*a* into a compression chamber V of the compression mechanism portion 20 which will be described later is provided between the sub-housing 12 and the lid member 13. Further, a driver circuit 30*a* for supplying an electric power to the electric motor portion 30 is fitted to a surface of the lid member 13 opposite to a surface on the sub-housing 12 side.

The electric motor portion 30 outputs a rotational driving force for driving the compression mechanism portion 20, and includes a stator 31 as a stator. The stator 31 includes a stator core 31*a* made of a magnetic material, and a stator coil 31*b* wound around the stator core 31*a*, and fixed to an inner peripheral surface of the cylindrical side surface of the main housing 11.

When the power is supplied to the stator coil 31*b* from the driver circuit 30*a*, a rotating magnetic field for rotating a cylinder rotor 21*a* disposed on an inner peripheral side of the stator coil 31*b* is generated. As illustrated in FIG. 2, the cylinder rotor 21*a* is formed of a metal cylindrical member having magnets (permanent magnets) 32, functions as a rotor of the electric motor portion 30, and configures a part of a cylinder 21 in the compression mechanism portion 20. The cylinder rotor 21*a* may be used as an example of the cylindrical member extending in a rotating axial direction of the cylinder 21.

In other words, in the compressor 1 of the present embodiment, the rotor of the electric motor portion 30 and a part (specifically, the cylinder rotor 21*a*) of the cylinder 21 in the compression mechanism portion 20 are configured integrally. It is needless to say that the rotor of the electric motor portion 30 and the cylinder 21 of the compression mechanism portion 20 may be configured by different members, and may be integrated together by a press fitting method or the like.

The compression mechanism portion 20 is configured by the cylinder 21 that internally partitions the compression chamber V, and an inner rotor 22 that is an example of a columnar member housed inside the cylinder 21, and having a columnar shape extending in an axial direction of a rotating axis of the cylinder 21. The compression mechanism portion 20 is further configured by a vane 23 that is an example of the partition member disposed inside the cylinder 21 and partitioning the compression chamber V, and a shaft 24 rotatably supporting the cylinder 21 and the inner rotor 22.

The cylinder 21 includes the cylinder rotor 21*a* that is an example of the cylindrical member described above, and first and second side plates 21*b* and 21*c* which are an example of a closing member for closing one axial end of the cylinder rotor 21*a*. In the present embodiment, a closing member disposed on a bottom side of the main housing 11 is called "first side plate 21*b*", and a closing member disposed on the sub-housing 12 side is called "second side plate 21*c*. The first side plate 21*b* may be used as an example of the first closing member for closing the one end in the axial direction of the cylindrical member, and the second side plate 21*c* may be used as an example of the second closing member for closing the other axial end of the cylindrical member.

The first and second side plates 21*b* and 21*c* each include a disk-shaped part extending in a direction substantially perpendicular to the rotating axis of the cylinder 21, and a boss disposed in the center of the disk-shaped part and projecting in the axial direction. Further, the bosses are provided with through holes that penetrate through the respective first and second side plates 21*b* and 21*c*.

Respective bearing mechanisms are disposed in those through holes, and those bearing mechanisms are inserted into the shaft 24 to rotatably support the cylinder 21 relative to the shaft 24. Both ends of the shaft 24 are fixed to the housing 10 (specifically, the main housing 11 and the sub-housing 12). Therefore, the shaft 24 is never rotated relative to the housing 10.

The shaft 24 is formed into a substantially columnar shape by the combination of multiple metal division members 24*a* and 24*b*, and a small diameter part smaller in outer diameter than both ends of the shaft 24 is provided in the axial center of the shaft 24.

The small diameter part configures an eccentric portion 24*c* that is eccentric with respect to a rotation center C1 of the cylinder 21, and the inner rotor 22 is rotatably supported to the eccentric portion 24*c* through the bearing mechanisms. Therefore, as illustrated in FIG. 2, a rotation center C2 of the inner rotor 22 is eccentric with respect to the rotation center C1 of the cylinder 21.

Furthermore, the shaft 24 is internally provided with a communication passage 24*d* that communicates with the suction passage 13*a* extending in the axial direction and provided between the sub-housing 12 and the lid member 13 to introduce the low-pressure refrigerant into the compression chamber V side. The shaft 24 also internally includes multiple (in the present embodiment, four) shaft side suction holes 24*e* extending in the radial direction and communicating the communication passage 24*d* with an outer peripheral side of the eccentric portion 24*c* are provided.

The inner rotor 22 has a substantially cylindrical shape, and an axial length of the inner rotor 22 is substantially equal to an axial length of the eccentric portion 24*c* of the shaft 24 and an axial length of the substantially cylindrical space inside the cylinder 21. An outer diameter of the inner rotor 22 is smaller than an inner diameter of the cylindrical space inside the cylinder 21.

In more detail, as illustrated in FIG. 2, when viewed from the axial direction of the rotating axis of the cylinder 21, the outer diameter of the inner rotor 22 is set so that an outer peripheral wall surface of the inner rotor 22 comes in contact with an inner peripheral wall surface (specifically, an inner peripheral wall surface of the cylinder rotor 21a) of the cylinder 21 at one contact point C3.

The outer peripheral wall surface of the inner rotor 22 is provided with a groove portion 22*a* recessed toward an inner peripheral side of the inner rotor 22 over an overall area in the axial direction, and the vane 23 is slidably fitted into the groove portion 22*a*. In addition, an inner rotor side suction hole 22*b* that communicates an inner peripheral side of the inner rotor 22 with an outer peripheral side of the inner rotor 22 is provided in a cylindrical side surface of the inner rotor 22.

The vane 23 has a plate-like member, and an axial length of the vane 23 is substantially equal to the axial length of the inner rotor 22. Furthermore, a hinge 23*a* provided in an outer peripheral side end of the vane 23 is swingably supported to the inner peripheral wall surface of the cylinder rotor 21*a*.

Therefore, in the compression mechanism portion 20 according to the present embodiment, the compression chamber V is partitioned by a space surrounded by the inner peripheral wall surface of the cylinder 21, the outer peripheral wall surface of the inner rotor 22, and a plate surface of the vane 23. The low-pressure refrigerant suctioned from the suction port 12*a* provided in the sub-housing 12 flows in the suction passage 13*a*, the communication passage 24*d*, the shaft side suction holes 24*e*, and the inner rotor side suction hole 22*b* in the stated order, and is suctioned into the compression chamber V.

On the other hand, the high-pressure refrigerant compressed in the compression chamber V flows into an internal space of the housing 10 from a discharge hole 21*d* provided in the first side plate 21*b*, and is discharged from the discharge port 11*a* provided in the main housing 11. The discharge hole 21*d* communicates with the compression chamber V displaced at a predetermined position.

In addition, a discharge valve 25 for restraining the refrigerant that has flowed into the internal space of the housing 10 from the discharge hole 21*d* from flowing back into the compression chamber V through the discharge hole 21*d* is disposed in the first side plate 21*b* of the present embodiment.

Figure 3:
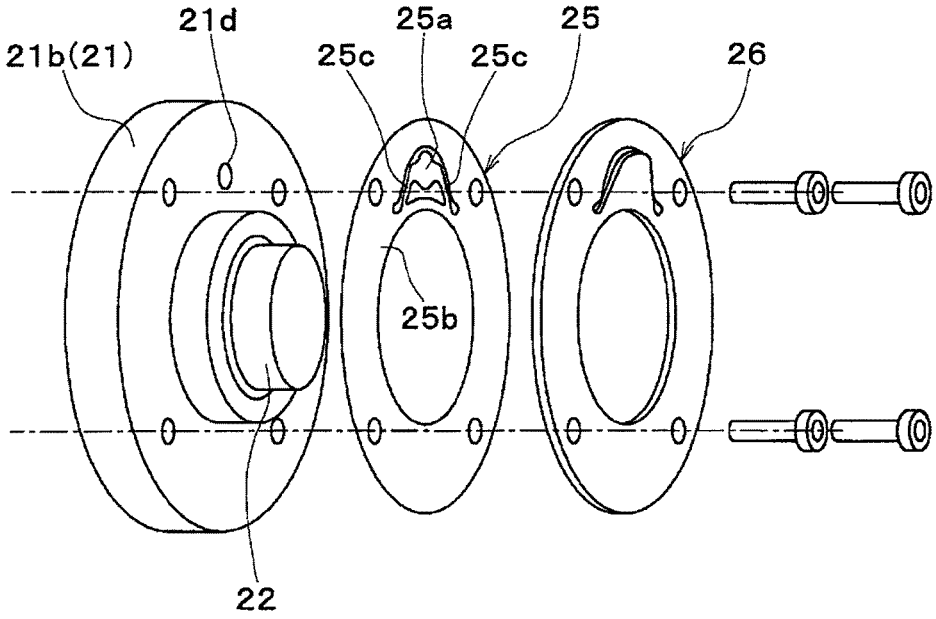
FIG. 3 is an exploded view illustrating a discharge valve according to the first embodiment.

As illustrated in FIG. 3, the discharge valve 25 is configured by a so-called reed valve that is formed of a disk-shaped thin plate and includes a valve body portion 25*a* that closes the discharge hole 21*d*, a fixing portion 25*b* that is fixed to the first side plate 21*b*, and support portions 25*c* that couple the valve body portion 25*a* with the fixing portion 25*b*, and are displaced when the valve body portion 25*a* opens or closes the discharge hole 21*d*. The fixing portion 25*b* has an annular shape that surrounds the periphery of an end of the inner rotor 22 projecting from the first side plate 21*b*. The discharge hole 21*d* is provided within an area of the fixing portion 25*b* having an annular shape in the radial direction of the cylinder 21. In other words, the discharge hole 21*d* is located approximately midway between an inner peripheral end and an outer peripheral end of the fixing portion 25*b*. The discharge hole 21*d* is covered with the valve body portion 25*a* coupled to the fixing portion 25*b* through the support portions 25*c*. The fixing portion 25*b* is fixed at multiple positions of regular intervals in a circumferential direction of the fixing portion 25*b*. For example, the fixing portion 25*b* has bolt holes at the regular intervals in the circumferential direction of the fixing portion 25*b*.

The discharge valve 25 is fixed to the first side plate 21*b* together with a stopper plate 26 that regulates a maximum displacement mount of the valve body portion 25*a* when the valve body portion 25*a* opens the discharge hole 21*d* by a fixing method such as bolting. The valve body portion 25*a* according to the present embodiment is disposed to abut against the first side plate 21*b* and close the discharge hole 21*d* even at a uniform pressure time when a refrigerant pressure in the internal space of the housing 10 is equivalent to a refrigerant pressure in the compression chamber V.

Figure 4:
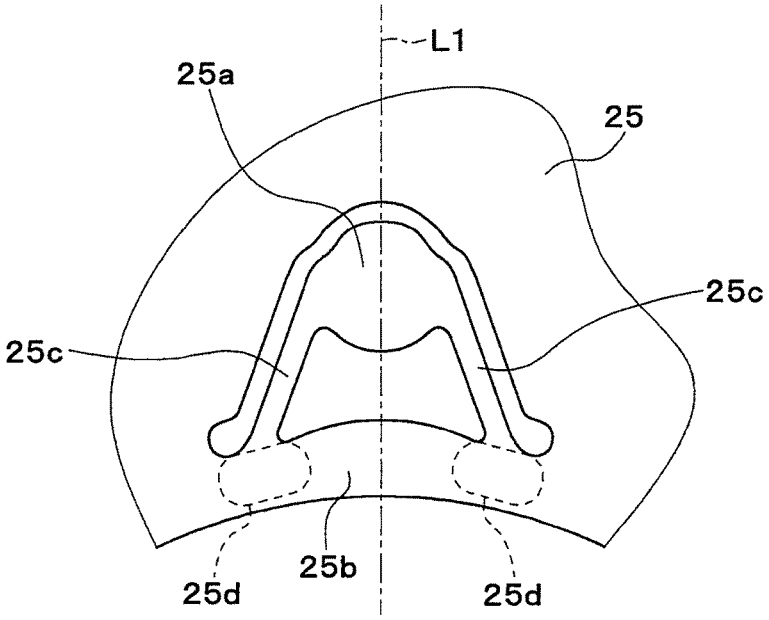
FIG. 4 is a diagram illustrating the discharge valve according to the first embodiment.

Furthermore, as illustrated in FIG. 4, when viewed from the axial direction of the rotating axis of the cylinder 21, the valve body portion 25*a* of the discharge valve 25 has a substantially circular shape. The multiple (two in the present embodiment) support portions 25*c* are provided in the discharge valve 25, and when viewed from the axial direction of the rotating axis of the cylinder 21, the support portions 25*c* extend from a position corresponding to an end of the valve body portion 25*a* in the circumferential direction of the rotating axis, in a direction inclined with respect to the radial direction of the rotating axis.

With the above configuration, as illustrated in FIG. 4, a shape of the valve body portion 25*a* and a shape of the support portions 25*c* in the present embodiment are symmetrical with respect to a line segment L1 extending in the radial direction of the rotating axis of the cylinder 21. Furthermore, the valve body portion 25*a* according to the present embodiment is disposed on a radially outer side of connection portions 25*d* connecting the fixing portion 25*b* and the support portions 25c.

Figure 5:
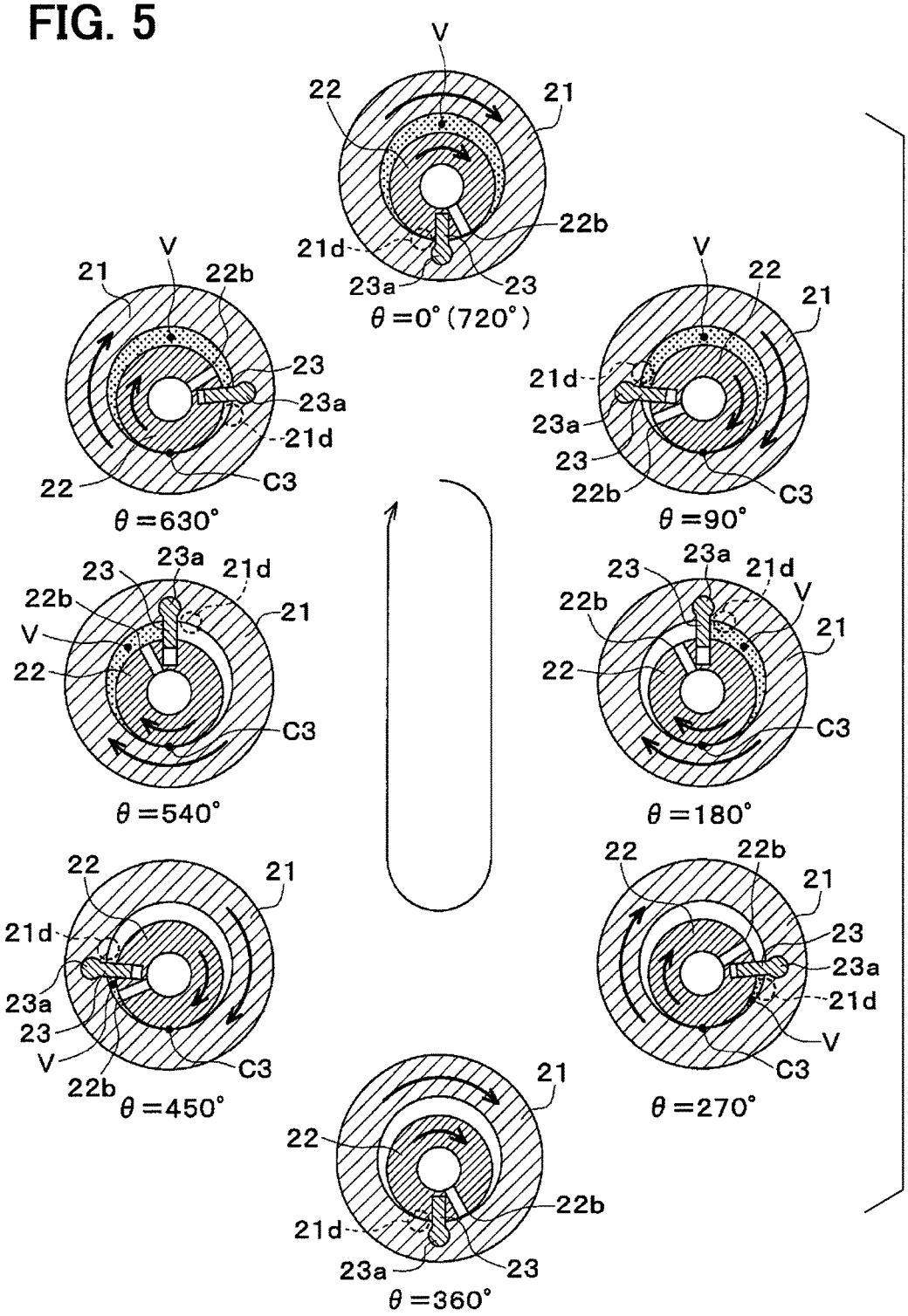
FIG. 5 is a diagram illustrating an operating state of the compressor according to the first embodiment.

Next, the operation of the compressor 1 according to the present embodiment will be described with reference to FIG. 5. FIG. 5 illustrates a change in the compression chamber V in association with the rotation of the cylinder 21, and the compression chamber V illustrated in FIG. 5 schematically illustrates the compression chamber V in a cross-section equivalent to that in FIG. 2.

For the purpose of clarifying the operating mode of the compressor 1, FIG. 5 illustrates a change in the compression chamber V while the cylinder 21 rotates twice, in other words, while a rotation angle θ of the cylinder 21 is changed from 0° to 720°. Further, in FIG. 5, the rotation directions of the cylinder 21 and the inner rotor 22 are indicated by thick solid arrows.

First, when the rotation angle θ is 0°, the contact point C3 matches the hinge 23*a* side of the vane 23, and a substantially entire area of the vane 23 is housed in the groove portion 22*a* of the inner rotor 22. Furthermore, a state at the rotation angle θ=0° is immediately before a communication between the inner rotor side suction hole 22*b* and the compression chamber V is blocked, and a capacity in the compression chamber V indicated by point hatching becomes a maximum capacity.

When the rotation angle θ increases, the hinge 23*a* of the vane 23 is separated from the contact point C3, and the inner rotor 22 rotates together with the vane 23. As a result, the communication between the inner rotor side suction hole 22*b* and the compression chamber V indicated by the point hatching is blocked. Further, as illustrated in FIG. 5, the capacity of the compression chamber V indicated by the point hatching is reduced more as the rotation angle θ increases more to 90°, 180°, and 270° in the stated order.

With the above configuration, the refrigerant pressure in the compression chamber V increases, and when the refrigerant pressure in the compression chamber V exceeds a valve opening pressure of the discharge valve 25 which is determined according to the refrigerant pressure in the internal space of the housing 10, the discharge valve 25 is opened, the refrigerant in the compression chamber V flows into the internal space of the housing 10. The high-pressure refrigerant that has flowed into the internal space of the housing 10 is discharged from the discharge port 11*a* of the housing 10.

Then, when the rotation angle θ reaches 360°, the capacity of the compression chamber V which is in a compression stroke becomes 0, resulting in the same state as a state in which the rotation angle θ is 0°.

Subsequently, the capacity of the compression chamber V indicated by the point hatching, which communicates with the inner rotor side suction hole 22*b* is increased in association with an increase of the rotation angle θ from 360°. Further, the capacity of the compression chamber V indicated by the point hatching is gradually increased more as the rotation angle θ increases more to 450°, 540°, and 630° in the stated order.

With the above configuration, the low-pressure refrigerant suctioned from the suction port 12*a* of the housing 10 is suctioned into the compression chamber V indicated by the point hatching, and when the rotation angle θ reaches 720°, the compression chamber V that is in a suction stroke becomes the maximum capacity.

In FIG. 5, in order to clearly describe the operating mode of the compressor 1 according to the present embodiment, the change in the compression chamber V while the rotation angle θ is changed from 0° to 720° has been described. However, actually, the compression stroke of the refrigerant described when the rotation angle θ is changed from 0° to 360° and the suction stroke described when the rotation angle θ is changed from 360° to 720° are performed at the same time when the cylinder rotates in one rotation.

As described above, the compressor 1 according to the present embodiment can suction, compress, and discharge the refrigerant (fluid) in the refrigeration cycle.

Further, according to the compressor 1 of the present embodiment, since the compression mechanism portion 20 is disposed on the inner peripheral side of the electric motor portion 30, the overall compressor 1 can be downsized. In addition, when the rotational speed of the compressor 1 (specifically, the cylinder 21 of the compression mechanism portion 20) during normal operation is set to a relatively high rotational speed, the maximum capacity of the compression chamber V can be reduced to a relatively small capacity, the compressor 1 can be further effectively downsized.

As in the compressor 1 according to the present embodiment, in the configuration where the discharge valve 25 is disposed in the cylinder 21, a centrifugal force acts on the discharge valve 25 when the cylinder 21 rotates. For that reason, when the rotational speed of the cylinder 21 during the normal operation is set to a relatively high rotational speed for the purpose of effectively reducing the size of the compressor 1, the centrifugal force acting on the discharge valve 25 is also increased.

In the case where the discharge valve 25 is displaced due to the action of the centrifugal force, and cannot close the discharge hole 21*d* when the cylinder 21 rotates at high rotations, there is a risk that the refrigerant cannot be compressed and discharged as the overall compressor 1.

On the contrary, in the compressor 1 according to the present embodiment, since the reed valve described with reference to FIG. 4 is employed as the discharge valve 25, the discharge valve high in sealing property can be realized without any increase in the size of the discharge valve 25.

In more detail, in the discharge valve 25 according to the present embodiment, as described with reference to FIG. 4, since the shape of the valve body portion 25*a* and the shape of the support portions 25*c* are substantially symmetrical with respect to the line segment L1 extending in the radial direction of the rotating axis, the valve body portion 25*a* can be hardly displaced in the rotation direction of the rotating axis even if the centrifugal force associated with the rotation of the cylinder 21 acts on the valve body portion 25*a*.

In addition, since the valve body portion 25*a* is disposed on the radially outer side of the connection portion 25*d* connecting the fixing portion 25*b* and the support portions 25*c*, the valve body portion 25*a* can be hardly displaced toward a radially outer peripheral side of the rotating axis even if the centrifugal force acts on the valve body portion 25*a*. Therefore, according to the compressor 1 of the present embodiment, the sealing property of the discharge valve 25 can be improved without any increase in the size of the discharge valve 25.

According to the compressor 1 of the present embodiment, when viewed from the axial direction of the rotating axis, the support portions 25*c* of the discharge valve 25 extend in a direction inclined with respect to the radial direction of the rotating axis. According to this configuration, a length extending from root parts (connection portions 25*d* with the fixing portion 25*b*) of the support portions 25*c* to a leading end part (connection portion with the valve body portion 25*a*) of the support portions 25*c* can be prolonged as compared with a case in which the support portions 25*c* extend in the radial direction of the rotating axis.

Therefore, a bending stress applied to the support portions 25*c* deformed when opening the valve body portion 25*a* or the discharge hole 21*d* can be reduced, and a durability lifetime of the valve body portion 25*a* can be improved.

In the present embodiment, the support portions 25*c* are shaped to extend in the direction inclined with respect to the radial direction of the rotating axis when viewed from the axial direction of the rotating axis. However, if the support portions 25*c* each include a portion shaped to extend in the direction inclined with respect to the radial direction, the support portions 25*c* are not limited to the above configuration. For example, the support portions 25*c* may have a meandering shape when viewed from the axial direction of the rotating axis.

In the compressor 1 according to the present embodiment, as described above, when the rotational speed during the normal operation is set to the relatively high rotational speed, the downsizing effect can be effectively obtained. Specifically, the rotational speed during the normal operation may be set to 5000 rpm or higher. Further, the rotational speed may be set to about 5000 rpm or higher and 6000 rpm or lower.

The reason is because, in the conventional art, a maximum rotational speed of general compressors (including not only an electric motor-driven compressor but also an engine-driven compressor) applied to the refrigeration cycle of a vehicle air conditioning apparatus is set to about 6000 rpm to 8000 rpm. In other words, when the rotational speed during the normal operation is set to about 5000 rpm or higher and 6000 rpm or lower, the compressor 1 can be downsized, and the durability of the same degree as that of the conventional compressors can be easily ensured.

The normal operation time of the compressor 1 in the present embodiment means a time when the compressor 1 operates, and the refrigeration cycle exerts a desired refrigerating capacity within an expected range.

(Second Embodiment)

Figure 6:
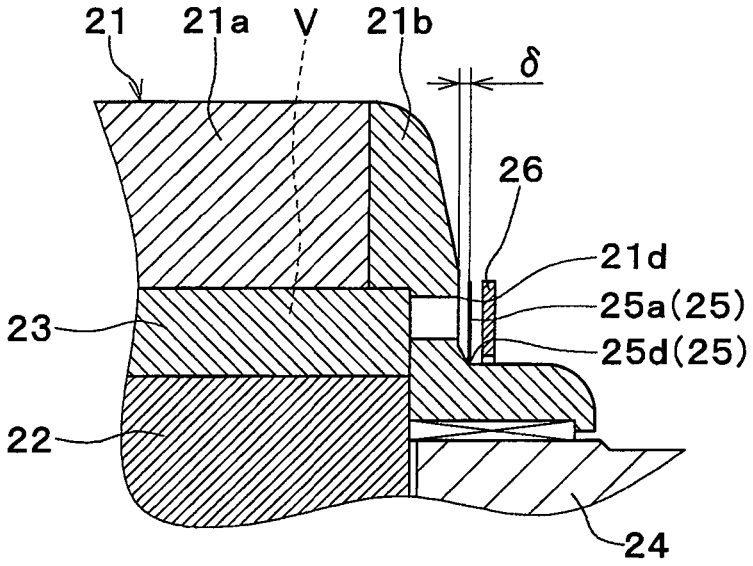
FIG. 6 is a cross-sectional view illustrating a part of a compressor according to a second embodiment of the present disclosure.

In the present embodiment, as compared with the first embodiment, as illustrated in FIG. 6, when viewed from a radial direction of a rotating axis of a cylinder 21, a discharge hole 21*d* is opened at a position closer to a compression chamber V than connection portions 25*d* of a discharge valve 25. In other words, an opening of the discharge hole 21*d* is located between the connection portions 25*d* of the discharge valve 25 and the compression chamber V in a rotating axial direction of the cylinder 21. FIG. 6 is an enlarged view of a portion corresponding to an X part in FIG. 1. In FIG. 6, identical portions with or equivalent portions to those in the first embodiment are denoted by the same reference numerals. The same is applied to the following drawings.

In more detail, in the present embodiment, since the discharge hole 21*d* is opened at a position closer to the compression chamber V than the connection portions 25*d*, a slight gap δ is provided between a valve body portion 25*a* and an opening portion of the discharge hole 21*d* at a uniform pressure time as illustrated in FIG. 6 when a refrigerant pressure in an internal space of a housing 10 is equivalent to a refrigerant pressure in the compression chamber V. In other words, the discharge valve 25 according to the present embodiment does not close the discharge hole 21*d* at the uniform pressure time. Other structures and operations are the same as those of the first embodiment.

In the present embodiment, although the discharge valve 25 does not close the discharge hole 21*d* at the uniform pressure time, the valve body portion 25*a* can be pushed toward the discharge hole 21*d* side to close the discharge hole 21*d* due to a differential pressure between the refrigerant pressure in the internal space of the housing 10 and the refrigerant pressure in the compression chamber V during the operation of the compressor 1. Therefore, even in the compressor according to the present embodiment, the refrigerant can be compressed and discharged as in the first embodiment.

Furthermore, in the compressor 1 according to the present embodiment, even not at the uniform pressure time, if the differential pressure between the refrigerant pressure in the internal space of the housing 10 and the refrigerant pressure in the compression chamber V is small, the discharge hole 21*d* can be opened. Therefore, the present embodiment is effective in that a valve opening response of the discharge valve 25 can be improved when the present embodiment is applied to the compressor 1 in which the rotational speed during the normal operation is set to the relatively high rotational speed as described in the first embodiment.

(Third Embodiment)

Figure 7:
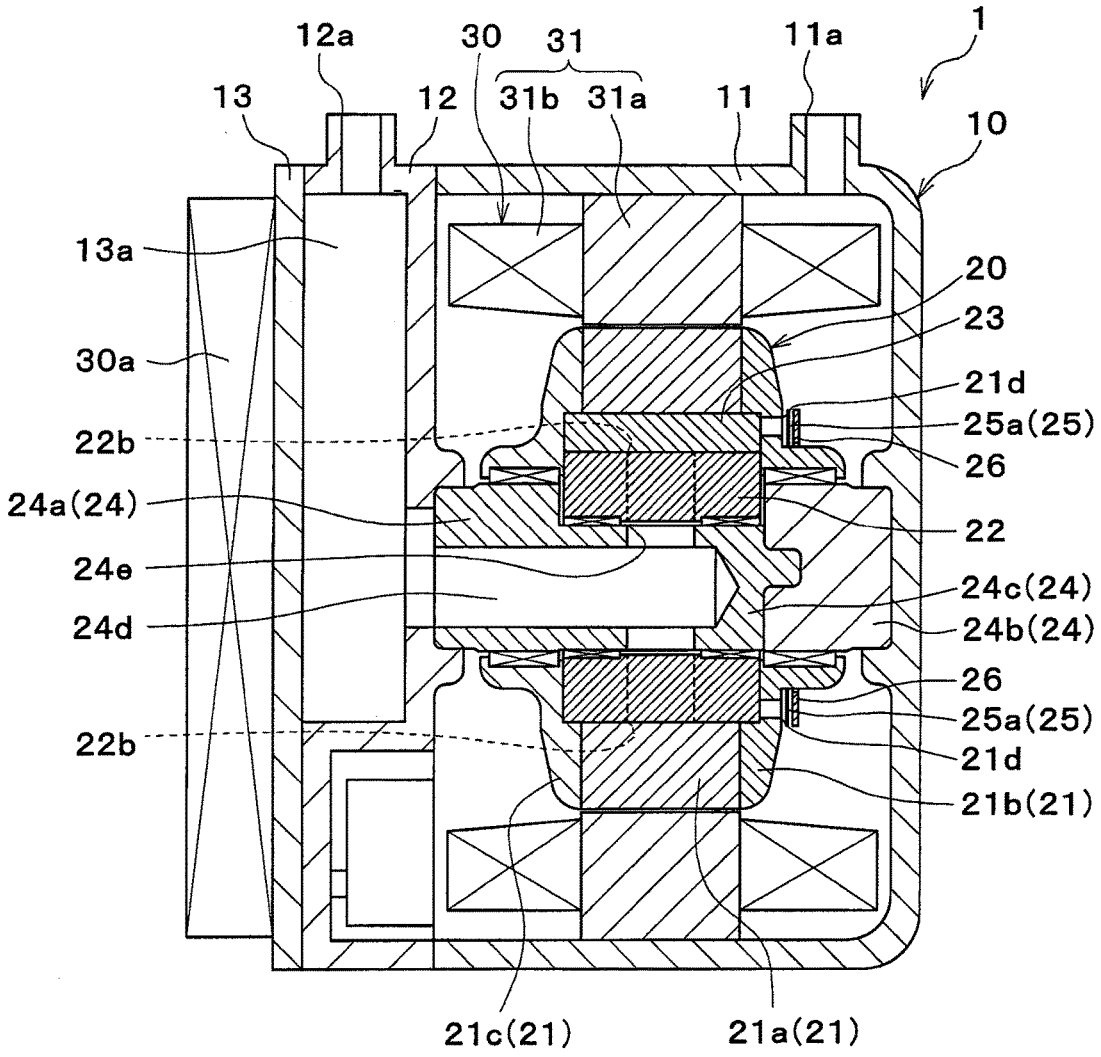
FIG. 7 is an axial cross-sectional view illustrating a compressor according to a third embodiment of the present disclosure.
Figure 8:
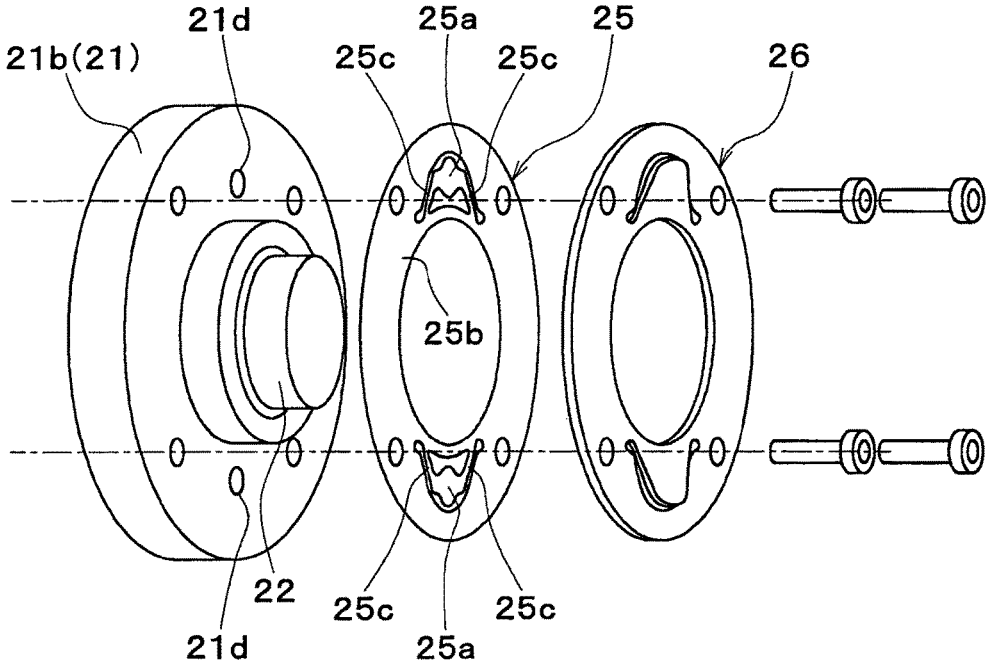
FIG. 8 is an exploded view illustrating a discharge valve according to the third embodiment.

In the present embodiment, as compared with the first embodiment, as illustrated in FIG. 7, multiple (two in the present embodiment) discharge holes 21*d* are provided in a first side plate 21*b*, and as illustrated in FIG. 8, multiple valve body portions 25*a* that close the respective discharge holes 21*d* and support portions 25*c* are provided in a discharge valve 25.

Figure 9:
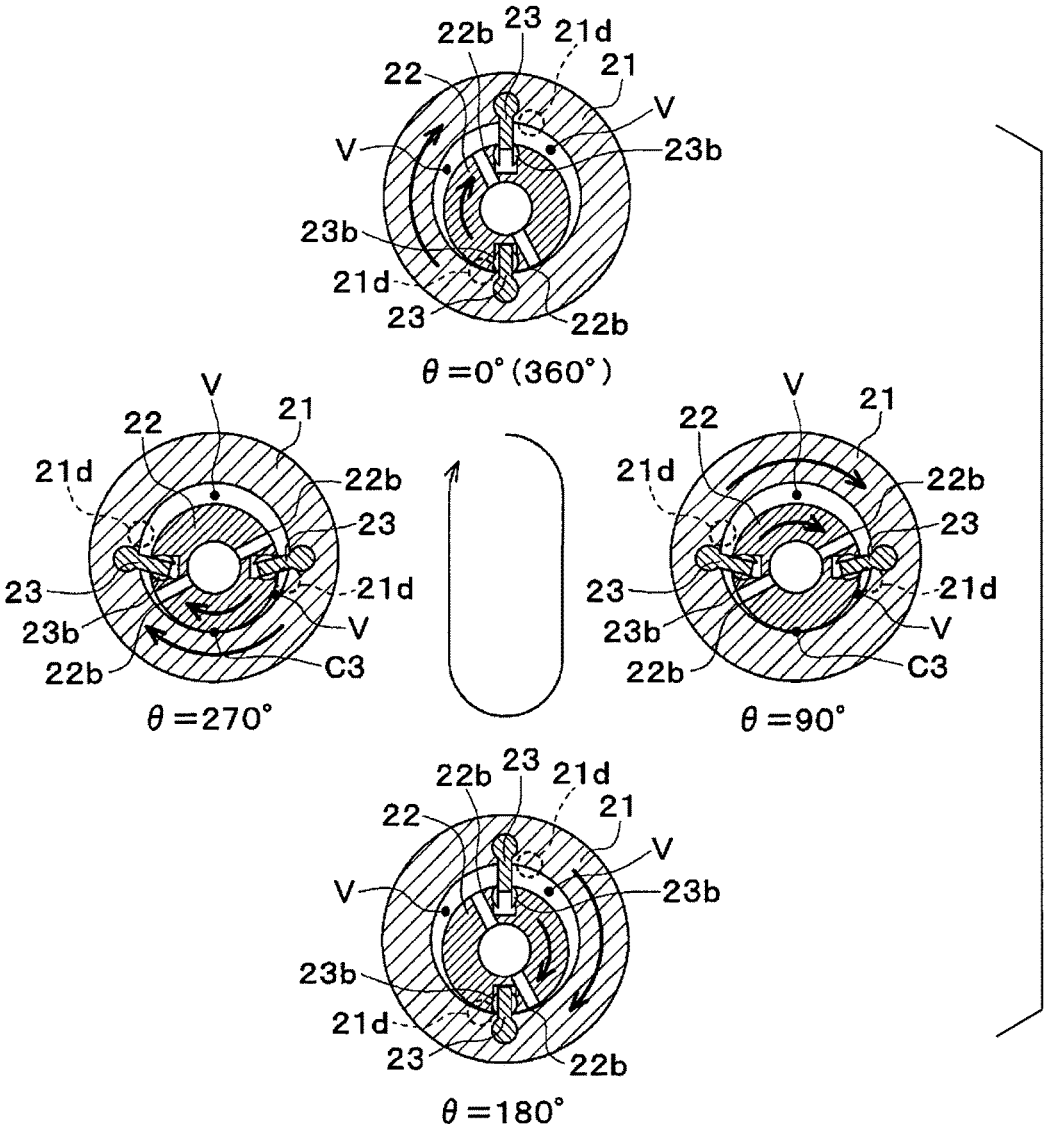
FIG. 9 is a diagram illustrating an operating state of the compressor according to the third embodiment.

Furthermore, as illustrated in FIG. 9, multiple (two in the present embodiment) vanes 23 are disposed in the interior of a cylinder 21 so as to partition compression chambers V corresponding to the multiple discharge holes 21*d*, and multiple (two in the present embodiment) inner rotor side suction holes 22*b* for introducing a low-pressure refrigerant into the respective compression chambers V are provided in a shaft 24.

FIG. 8 is a diagram corresponding to FIG. 4 illustrating the first embodiment. FIG. 9 is a diagram corresponding to FIG. 5 illustrating the first embodiment, and illustrates states in which a rotation angle θ is 0° (360°), 90°, 180°, and 270°.

In the present embodiment, in order to restrain a refrigerant from being leaked from a gap between a groove portion 22*a* of an inner rotor 22 and the vane 23 when the cylinder 21 rotates, as illustrated in FIG. 9, a shoe 23*b* having a shape (substantially semi-circular shape) in which a part of a circle is cut off when viewed from an axial direction of a rotating axis is disposed inside the groove portion 22*a*.

Further, as is apparent from FIGS. 8 and 9, when viewed from the axial direction of the rotating axis of the cylinder 21, the multiple discharge holes 21*d* and the valve body portions 25*a* are disposed at regular angular intervals (180° intervals in the present embodiment). In other words, the multiple discharge holes 21*d* and the valve body portions 25*a* are disposed at the regular angular intervals in a rotation direction of the cylinder 21. Other structures and operations are the same as those of the first embodiment.

Therefore, according to the compressor 1 of the present embodiment, the same advantages as those in the first embodiment can be obtained. Furthermore, in the compressor 1 according to the present embodiment, the refrigerant can be compressed and discharged in the multiple compression chambers V, and a pressure pulsation of the refrigerant discharged from the compressor 1 can be suppressed. In addition, in the compressor 1 according to the present embodiment, since the multiple discharge holes 21*d* and the valve body portions 25*a* are disposed at the regular angular intervals, a rotational balance when the compression mechanism portion 20 rotates can be improved.

(Fourth Embodiment)

Figure 10:
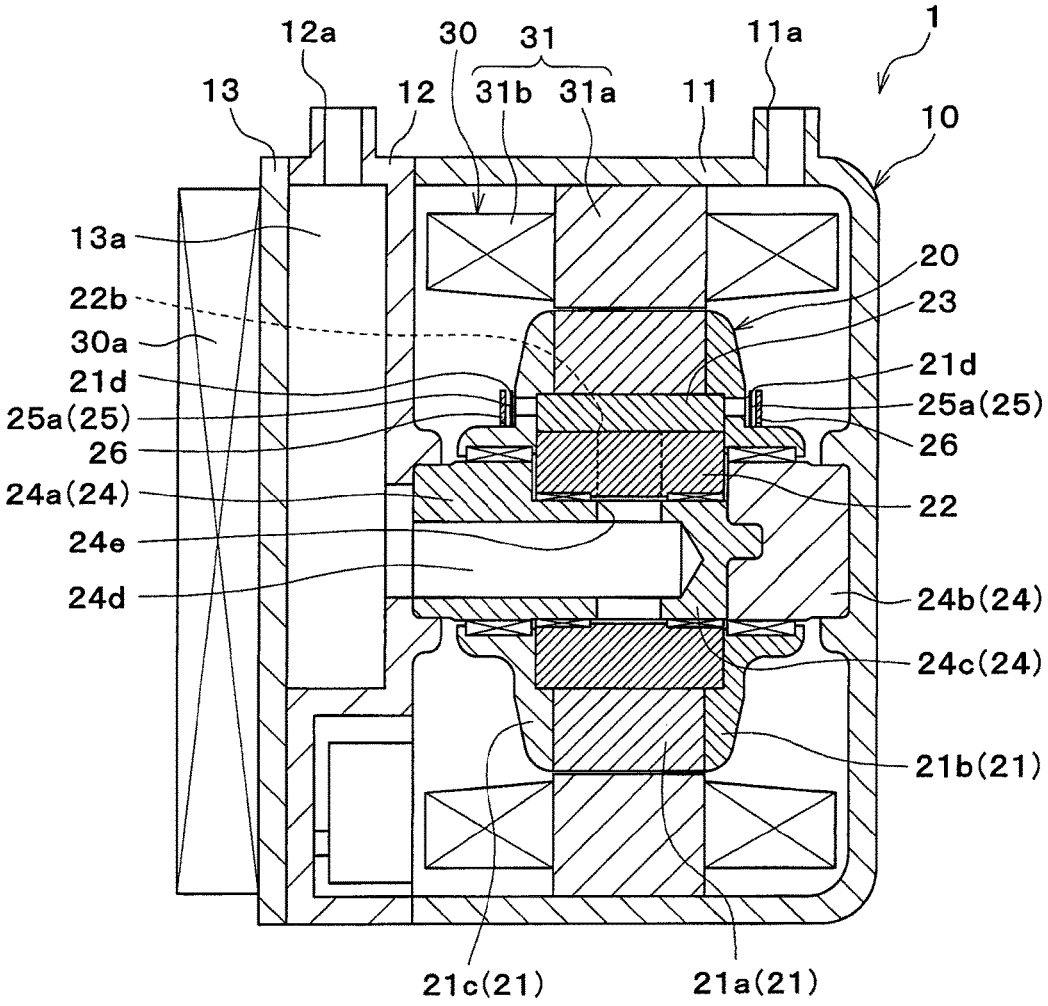
FIG. 10 is an axial cross-sectional view illustrating a compressor according to a fourth embodiment of the present disclosure.

In the present embodiment, as compared with the first embodiment, as illustrated in FIG. 10, a discharge hole 21*d* is provided in each of a first side plate 21*b* and a second side plate 21*c*. Further, a discharge valve 25 is fixed to each of the first side plate 21*b* and the second side plate 21*c* together with a stopper plate 26 so as to close each of the discharge holes 21*d*. The respective discharge holes 21*d* overlap with each other when viewed from an axial direction of a rotating axis. Other structures and operations are the same as those of the first embodiment.

Therefore, according to the compressor 1 of the present embodiment, the same advantages as those in the first embodiment can be obtained. Further, in the compressor 1 according to the present embodiment, since a refrigerant can be discharged from the discharge holes 21*d* provided in both of the first side plate 21*b* and the second side plate 21*c*, the pressure in an internal space of a housing 10 can be uniformed. As a result, the cylinder 21 can be restrained from undergoing an unnecessary eccentric load due to a pressure distribution of the refrigerant in the internal space of the housing 10.

The present disclosure is not limited to the above-described embodiments, but various modifications can be made thereto as follows without departing from the spirit of the present disclosure.

In the embodiments described above, the examples in which the cylinder-rotation-type compressor 1 of the present disclosure is applied to the refrigeration cycle (vehicle refrigeration cycle device) of the vehicle air conditioning apparatus have been described, but the application of the cylinder-rotation-type compressor 1 according to the present disclosure is not limited to the above configuration. In other words, the cylinder-rotation-type compressor 1 according to the present disclosure can be applied to a wide range of application as the compressor that compresses various types of fluids.

In the embodiments described above, the cylinder-rotation-type compressor 1 of the type in which the cylinder 21 and the inner rotor 22 are interlockingly rotated with different rotating axes to displace the vane 23 and change the capacity of the compression chamber has been described. However, the type of the cylinder-rotation-type compressor according to the present disclosure is not limited to the above configuration.

For example, a type in which the hinge of the vane is eliminated, the inner rotor is fixed to the shaft or the housing, and the cylinder is rotated relative to the inner rotor to displace the vane and change the capacity of the compression chamber may be applied.

Figure 11:
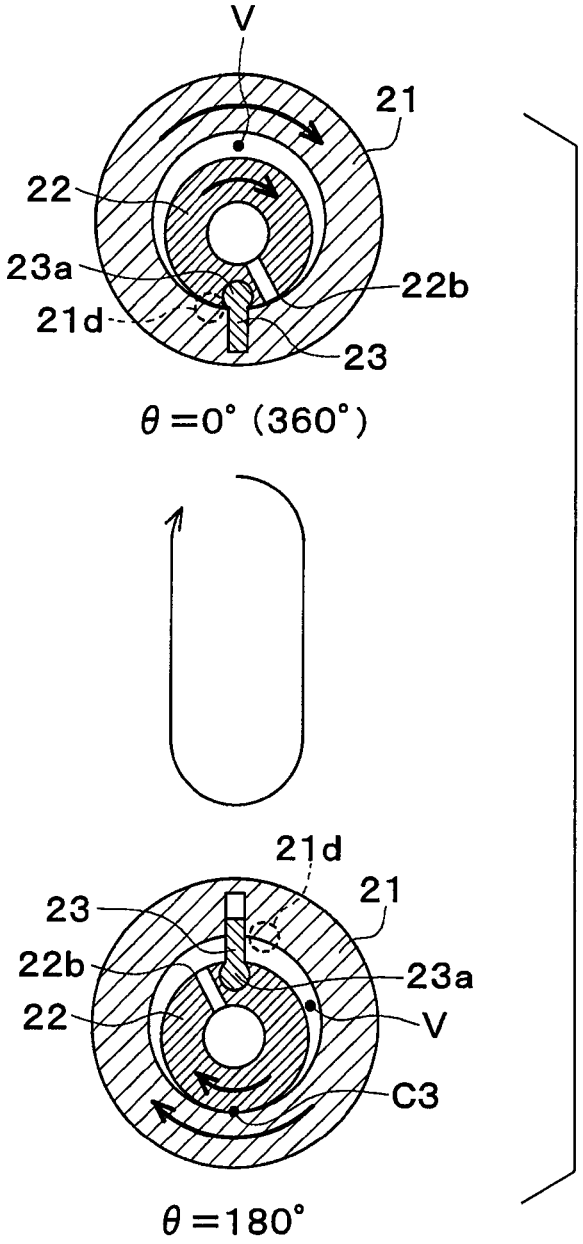
FIG. 11 is a diagram illustrating an operating state of a compressor according to a modification of the present disclosure.

In addition, in the embodiments described above, the example in which the hinge 23*a* of the vane 23 is swingably fixed to the cylinder 21 has been described. Alternatively, as illustrated in FIG. 11, a type in which the hinge 23*a* of the vane 23 may be swingably fixed to the inner rotor 22 may be applied. Meanwhile, FIG. 11 is a diagram corresponding to FIG. 5 illustrating the first embodiment, and illustrates states in which the rotation angle θ is 0° (360°) and 180°.

Further, in the embodiments described above, the example in which the cylinder-rotation-type compressor 1 is configured as the electric compressor, and the compression mechanism portion 20 is driven by a rotational driving force output from the electric motor portion 30 has been described. Alternatively, the compression mechanism portion 20 may be driven by the rotational driving force output from an engine (internal combustion engine).

The configuration disclosed in the above respective embodiments may be appropriately combined together in a feasible range. For example, the discharge hole 21*d* opened at the position closer to the compression chamber V employed in the second embodiment may be applied to the third or fourth embodiment. In addition, in the fourth embodiment, as in the third embodiment, the multiple discharge holes 21*d* may be provided in both of the first and second side plates 21*b* and 21*c*.

What is claimed is:

1. A cylinder-rotation compressor comprising:

a rotatable cylinder that includes a cylindrical member which extends in an axial direction of a rotating axis, and a closing member which closes an end of the cylindrical member in the axial direction;

a columnar member which is housed inside the rotatable cylinder and extends in the axial direction of the rotating axis of the rotatable cylinder; and a partition member which is slidably fitted into a groove portion provided in one of the rotatable cylinder and the columnar member, and partitions a compression chamber provided between the rotatable cylinder and the columnar member, wherein the closing member includes a discharge hole through which a fluid compressed in the compression chamber flows out of the compression chamber, the cylinder-rotation compressor further comprising a discharge valve that limits backward flow of the fluid into the compression chamber through the discharge hole, the discharge valve is a plate-shaped member, and includes a valve body portion that closes the discharge hole, a fixing portion that is fixed to the rotatable cylinder, and a support portion that couples the valve body portion with the fixing portion, a shape of the valve body portion and a shape of the support portion are substantially symmetrical with respect to a line segment extending in a radial direction of the rotating axis when viewed from the axial direction of the rotating axis, and the valve body portion is disposed on a radially outer side of a connection portion connecting the fixing portion and the support portion.

2. The cylinder-rotation compressor according to claim 1, wherein the support portion includes a portion having a shape extending in a direction inclined with respect to the radial direction.

3. The cylinder-rotation compressor according to claim 1, wherein an opening of the discharge hole is located between the connection portion and the compression chamber in the axial direction of the rotating axis.

4. The cylinder-rotation compressor according to claim 1, wherein the discharge hole includes a plurality of discharge holes, the valve body portion includes a plurality of valve body portions, and the plurality of discharge holes and the plurality of valve body portions are disposed at regular angular intervals in a rotation direction of the rotatable cylinder.

5. The cylinder-rotation compressor according to claim 1, wherein the discharge hole includes a plurality of discharge holes, the valve body portion includes a plurality of valve body portions, the closing member includes a first closing member that closes one end of the cylindrical member in the axial direction, and a second closing member that closes another end of the cylindrical member in the axial direction, the first closing member includes at least one of the plurality of discharge holes, and the second closing member includes at least one of the plurality of discharge holes.

* * * * *